United States Patent [19]

Röck et al.

[11] Patent Number: 4,728,200

[45] Date of Patent: Mar. 1, 1988

[54] EXTENSION PULL-OUT GUIDE ASSEMBLY FOR DRAWERS

[75] Inventors: Erich Röck, Höchst; Felix Schwärzler, Hohenems, both of Austria

[73] Assignee: Julius Blum Gesellschaft m.b.H., Höchst, Austria

[21] Appl. No.: 915,124

[22] Filed: Oct. 1, 1986

[30] Foreign Application Priority Data

Oct. 21, 1985 [AT] Austria ..... 3037/85

[51] Int. Cl.[4] ..... F16C 29/10

[52] U.S. Cl. ..... 384/19

[58] Field of Search ..... 384/19, 18, 21; 312/341 R, 350

[56] References Cited

U.S. PATENT DOCUMENTS 3,462,203 8/1969 Del Vecchio ..... 384/19

3,647,271 3/1972 Allred ..... 384/21

4,508,394 4/1985 Röck ..... 384/19

*Primary Examiner*—Lenard A. Footland

*Attorney, Agent, or Firm*—Wenderoth, Lind & Ponack

[57] ABSTRACT

An extension pull-out guide assembly for each side of a drawer includes a pull-out rail fastened to the drawer, a supporting rail on each side of a furniture body and a center rail arranged between the pull-out rail and the supporting rail. A runner roller is mounted on the center rail. The supporting rail has stop members for the runner roller of the center rail to limit the extracting movement of the center rail. The stop members hold the runner roller of the center rail in clamping arrangement between a first passable stop member that can be overrun and a second unpassable stop member. Thus, unintentional displacement of the center rail in the extracted position towards the front as well as towards the rear is prevented.

8 Claims, 4 Drawing Figures

EXTENSION PULL-OUT GUIDE ASSEMBLY FOR DRAWERS

FIELD AND BACKGROUND OF THE INVENTION

The present invention relates to an extension pull-out guide assembly for each side of a drawer and including a pull-out rail fastened to the drawer, a supporting rail on the side of a furniture body and a center rail arranged between the pull-out rail and the supporting rail, with a runner rollers being mounted on the center rail, the supporting rail having stops for the runner roller of the center rail for limiting the extracting path of the center rail.

Due to the fact that pull-out guide assemblies of the afore-mentioned kind have at each side of the drawer a supporting rail at the side of the furniture body, a center rail and a pull-out rail at the side of the drawer, the drawer and the pull-out rails are fully extractable from the body of the article of furniture. Access to objects which are in the rearmost part of the drawer thereby is facilitated. The same system is also employed in so-called suspended file cabinets. In such cabinets access to the rearmost part of the drawer or cabinet must also be easily possible.

It is a disadvantage of conventional extension pull-out guide assemblies that the three rails on each side, i.e. the supporting rail, the center rail and the pull-out rail, cannot be separated in general. If they are separable, some of the conventional assemblies involve the risk that this separation occurs unintentionally, and as a result the drawer falls down.

SUMMARY OF THE INVENTION

It is the object of the invention to improve such an extension pull-out guide assembly by providing that the center rails can be held in the extracted position. This facilitates access to the drawer. It also is possible, however, to push the center rails back into the body of the article of furniture without having to release a lock, e.g. a catch member.

It is a further object of the invention to provide a complete pull-out guide assembly of the afore-mentioned kind which permits easy dismounting of the center rail without creating the risk of disengaging the center rail fully and unintentionally from the supporting rail.

According to the invention these objects are achieved by providing stop members to hold the runner roller of the center rail in clamping arrangement between a first passable stop that can be overrun, and a second passable stop Thus, unintentional displacement of the center rails in the extracted position towards the front as well as towards the rear is prevented.

It is advantageously provided that the supporting rail has a C-shaped profile or a U-shaped profile with upper and lower horizontal flanges projecting opposite ends of a vertical flange and with a further vertical flange projecting upwardly from the lower horizontal flange. The stops are arranged at the upper horizontal flange. The further vertical flange projecting from the lower horizontal flange has a recess through which can pass the runner roller of the center rail. Such recess is positioned opposite the rear stop in the upper horizontal flange.

When the center rail is in the fully inserted position, it can be laterally pivoted and removed from the supporting rail because the recess in the further vertical flange permits passage of the runner roller of the center rail from the supporting rail.

For this purposes, the stop opposite the recess is advantageously arranged at the rear end of the supporting rail.

An embodiment of the invention provides that are stop laterally overlaps the runner roller of the center rail. Thereby, unintentional lateral motion of the center rail is prevented, even when the tolerances between the drawer and the body of the article of furniture and the rails of the extension pull-out guide assembly are great.

It is further advantageously provided that the stops are of resilient material, such as rubber or plastics material.

One embodiment provides that openings are punched out of the vertical flange of the supporting rail, with the stops being inserted through the openings into the upper horizontal flange of the supporting rail.

BRIEF DESCRIPTION OF THE DRAWINGS

Below an embodiment of the invention will be described in more detail with reference to the accompanying drawings, in which.

DESCRIPTION OF THE PREFERRED EMBODIMENT

Figure 3:
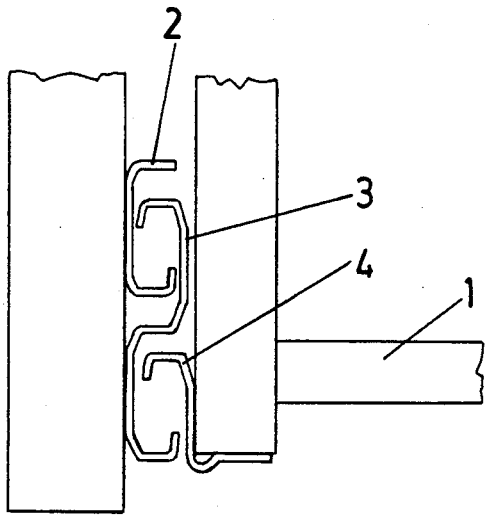
FIG. 3 is a schematic front view of the complete pull-out guide assembly, the adjoining parts of the drawer and of the body of an article of furniture also being shown.

The extension pull-out guide assembly according to the invention comprises in a conventional manner at each side of a drawer 1 a supporting rail 2 at the side of the body of furniture, a center rail 3 and a pull-out rail 4 at the side of the drawer. The drawer 1 is indicated in FIG. 3 by the drawer side wall and by the drawer bottom only. The body of the piece of furniture is shown by a part of a side wall thereof.

In the illustrated embodiment, the supporting rail 2 has stops 5,6. Such stops 5,6 are of resilient material, e.g. rubber or plastics material limit and respectively the rearward and forward movement of the center rail 3 relative to supporting rail 2. Stop 5 forms a rear stop and stop 6 forms a front stop for a runner roller 7 of the center rail 3.

Figure 4:
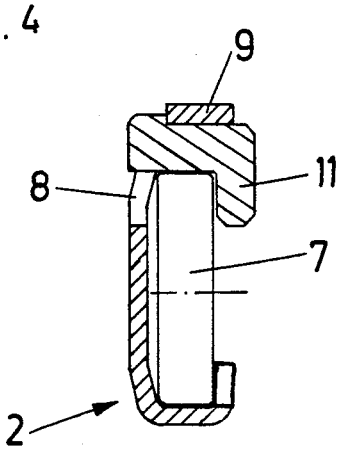
FIG. 4 is a sectional view along line I—I of FIG. 1.

As can be seen from FIG. 4, the supporting rail 2 has a punched opening 8 within which the stop 5 engages. The stop 5 extends across upper horizontal flange 9 of the supporting rail 2.

The stop 5 has a substantially Z-shaped cross-section (see FIG. 4).

In the region of stop 5, the upper horizontal flange 9 of the supporting rail 2 has a V-shaped angular portion 10, when viewed from the side. Due to this angular portion 10, the stop 5 is fixedly held on the supporting rail 2.

As can be seen from FIG. 4, the stop 5 extends with a lateral projection 11 over the front of runner roller 7. Thus, tilting of the runner roller 7 about a lower pivot axis is prevented, and unintentional lateral motion of the center rail 3 and runner roller 7 is also prevented.

At the bottom, the supporting rail 2 has a vertical flange 12 which forms a lateral guide for the runner roller 7.

A recess 13 is arranged in flange 12 opposite the stop 5. In the illustrated embodiment, recess 13 is limited at the front by an end of the vertical flange 12 and at the rear by an angular projection 14 extending from a lower horizontal flange 12*a* of the supporting rail 2 which forms a running flange for the runner roller 7.

When the drawer 1 and pull-out rails 4 have been extracted from the center rails 3 (in a manner to be described below), each center rail 3 can, if fully pushed back into the respective supporting rail 2, be pivoted laterally away from the body side wall and the runner roller 7 can thus be moved out through the recess 13, thereby removing center rail 3 from supporting rail 2.

As already mentioned, the stop 6 limits the path of runner roller 7 at the front of supporting rail 2.

Figure 2:
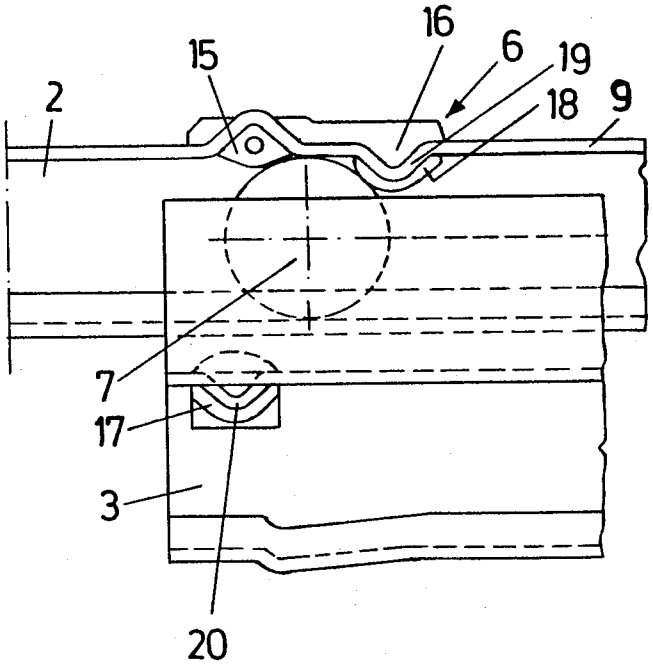
FIG. 2 is a view similar to FIG. 1, but with the pull-out guide assembly in the extracted position.
Figure 1:
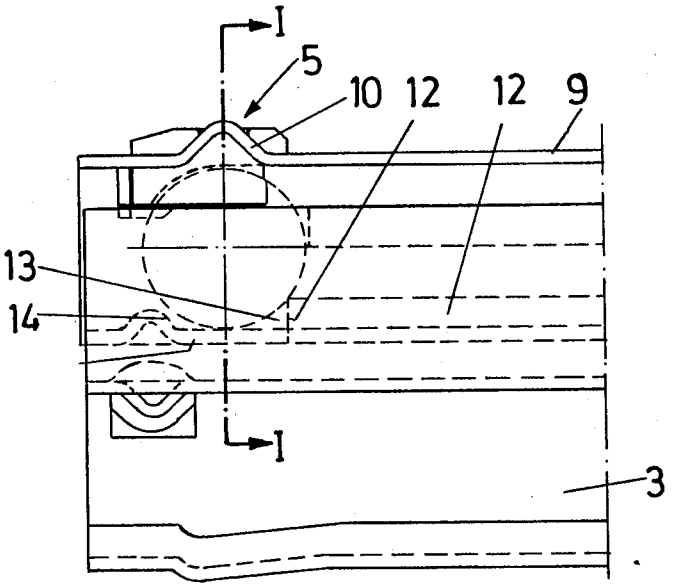
FIG. 1 is a schematic side view of an extension pull-out guide assembly of the present invention, shown in the inserted condition, the drawer being omitted for the sake of clarity.

Stop 6 has a rear stop member 15 and a front stop member 16. Normally the runner roller 7 is moved forwards until it abuts at the stop member 15. If, however, the center rail 3 is to be fixed on the supporting rail 2 in the direction of displacement, e.g. when the drawer 1 and pull-out rails 4 are to be removed, the runner roller 7 is pulled further beyond the stop member 15, which is resilient, into the position shown in FIG. 2 and is clamped between stop members 15, 16. Thus the runner roller 7 and the center rail 3 are fixedly held on the supporting rail 2.

In the drawings, stop 17 on the center rail 3 also is shown. Stop 17 forms a rear buffer for a runner roller (not shown) of the pull-out rail 4 at the side of the drawer.

Even when the whole or parts of stop 17 or of a rim 18 of portion 16 of stop 6 break because of excessive wear, the function of the extension pull-out guide assembly is guaranteed, because the respective runner rollers push against angular portions 19,20 of the horizontal flanges of the respective rails.

What is claimed is:

1. An extension pull-out guide assembly for use on each of opposite sides of a drawer to enable the drawer to be slidably insertable into and withdrawable from a cabinet or article of furniture, said assembly comprising:

a supporting rail to be fixed to the body of the cabinet or article of furniture, a pull-out rail to be fixed to the drawer;

a center rail mounted between said supporting and pull-out rails and slidable relative thereto, said center rail having mounted thereon at least one runner roller rollingly positioned within said supporting rail;

whereby said pull-out rail is slidable relative to said center rail and said center rail is slidable relative to said supporting and pull-out rails during insertion and withdrawal movements of the drawer relative to the cabinet or article of furniture; and front stop means on said supporting rail for limiting withdrawal movement of said center rail relative to said supporting rail and for holding said center rail at a maximum pull-out position relative to said supporting rail, said front stop means comprising a first stop member to be abutted by said runner roller to thereby limit normal relative withdrawal movement of said center rail, said first stop member being passable by said runner roller upon further withdrawal movement of said center rail, and a second stop member to be abutted by said runner roller upon said further withdrawal movement and unpassable thereby, whereby said runner roller is clamped between said first and second stop members, thereby preventing unintentional movement of said center rail relative to said supporting rail in either the insertion or withdrawal directions.

2. An assembly as claimed in claim 1, further comprising rear stop means on said supporting rail for being abutted by said runner roller and thereby limiting insertion movement of said center rail relative to said supporting rail.

3. An assembly as claimed in claim 2, wherein said supporting rail has a substantially C-shaped cross section defined by a vertical flange, upper and lower horizontal flanges extending respectively from upper and lower ends of said vertical flange, and a further vertical flange extending upwardly from said lower horizontal flange.

4. An assembly as claimed in claim 3, wherein said front and rear stop means are provided at said upper horizontal flange.

5. An assembly as claimed in claim 4, further comprising a recess formed in said further vertical flange at a position opposite said rear stop means, thereby defining means for, upon said pull-out rail being removed from said center rail, enabling lateral movement of said runner roller relative to said supporting rail and thereby removal of said center rail from said supporting rail.

6. An assembly as claimed in claim 3, further comprising openings formed in said vertical flange, said stop means extending through said openings.

7. An assembly as claimed in claim 2, wherein said rear stop means extends over said runner roller.

8. An assembly as claimed in claim 2, wherein at least said first stop member is formed of resilient material.

* * * * *